United States Patent [19]

Genev

[11] 4,199,113

[45] Apr. 22, 1980

[54] DISC-TYPE APPARATUS FOR CRUSHING HARD MATERIALS

[75] Inventor: Ivan V. Genev, Sofia, Bulgaria

[73] Assignee: DSO "Cherna Metalurgia", Sofia, Bulgaria

[21] Appl. No.: 951,154

[22] Filed: Oct. 13, 1978

Related U.S. Application Data

[63] Continuation-in-part of Ser. No. 661,489, Feb. 26, 1976, abandoned, and Ser. No. 795,153, May 9, 1977, abandoned.

[30] Foreign Application Priority Data

Feb. 26, 1975 [BG] Bulgaria ..... 29087

[51] Int. Cl.[2] ..... B02C 19/00

[52] U.S. Cl. .....241/167; 241/252; 241/259.3

[58] Field of Search ..... 241/103, 109, 112, 117, 241/119, 121, 167, 244, 245, 252, 254, 259.1, 259.3, 601

[56] References Cited

U.S. PATENT DOCUMENTS

| | | | |
|---|---|---|---|
| 2,083,462 | 6/1937 | Long et al. | 241/252 |
| 2,601,954 | 7/1952 | Crites | 241/252 |
| 2,875,959 | 3/1959 | Calkins | 241/167 X |
| 3,138,337 | 6/1964 | Bogot et al. | 241/103 |
| 3,556,419 | 1/1971 | Frangquist et al. | 241/119 X |

FOREIGN PATENT DOCUMENTS

| | | | |
|---|---|---|---|
| 790632 | 11/1935 | France | 241/252 |
| 139919 | 3/1960 | U.S.S.R. | 241/252 |

*Primary Examiner*—Howard N. Goldberg

[57] ABSTRACT

A pair of cooperable rotatable discs of differing shape are supported in a housing for crushing hard and/or abrasive materials. A first one of the discs is planar in shape and is horizontally supported for rotation about a vertical axis. The cooperating disc is of conical shape, and is movable toward and away from the first disc along a second oblique axis, and is also supported for rotation in the housing about such oblique axis. Material to be crushed is deposited on the horizontal surface of the first disc, and after being crushed between the discs is carried by the first disc to be swept into the bottom of the crusher housing by means of a first rake or comb located above the upper material-bearing surface of the first disc. A second rake affixed to the lower surface of the first disc aids in discharging the crushed material from the bottom of the housing through an outlet chute.

7 Claims, 4 Drawing Figures

DISC-TYPE APPARATUS FOR CRUSHING HARD MATERIALS

This application is a continuation-in-part of application Ser. No. 661,489, filed Feb. 26, 1976, now abandoned, and of application Ser. No. 795,153, filed May 9, 1977, now abandoned.

BACKGROUND OF THE INVENTION

The invention relates to apparatus for crushing hard materials, and more particularly to arrangements of this type in which the material to be crushed is introduced onto a disc.

In known arrangements of this type, the material is crushed by means of a plurality of heavy wheels which roll over the disc.

Such arrangements have several disadvantages. Firstly, it is difficult, if not impossible, to obtain uniformity in the grain size of the crushed material, or to adjust the apparatus to produce different desired nominal grain sizes or fractions.

Additionally, in spite of the relatively high cost and complexity of such known arrangements, the moving wheels are subject to rapid wear when the materials to be crushed are abrasive, such rapid wear being primarily a result of the different peripheral velocities of the disc and the contacting wheels.

SUMMARY OF THE INVENTION

The arrangement of the present invention provides an efficient and inexpensive way of crushing hard and abrasive materials, and completely avoids the above disadvantages. In an illustrative embodiment, the crushing facilities are defined by first and second cooperating discs which are supported in a common housing, the first material-receiving disc being substantially planar in shape and the second disc being substantially conical in shape.

The first disc is supported for rotation about a vertical axis in the housing, while the second disc is supported for rotation in the housing about a second axis oblique to and intersecting the first axis. Such second disc is carried by a bearing housing which in turn is supported by springs and locking members for adjustable positioning along the second axis, thereby accommodating any adjustable nominal grain size of the material to be crushed.

The material is deposited on the upper surface of the planar first disc, and is thereafter rotated into registration with the overlying, oblique conical disc. The resulting crushed material is swept into the bottom of the housing by means of a first rake that is associated with the upper surface of the first disc, and a second rake affixed to the bottom surface of the first disc is effective to push the crushed material out of the housing via a discharge chute.

BRIEF DESCRIPTION OF THE DRAWING

The invention is further set forth in the following detailed description taken in conjuction with the appended drawing, in which.

DETAILED DESCRIPTION

Figure 1:
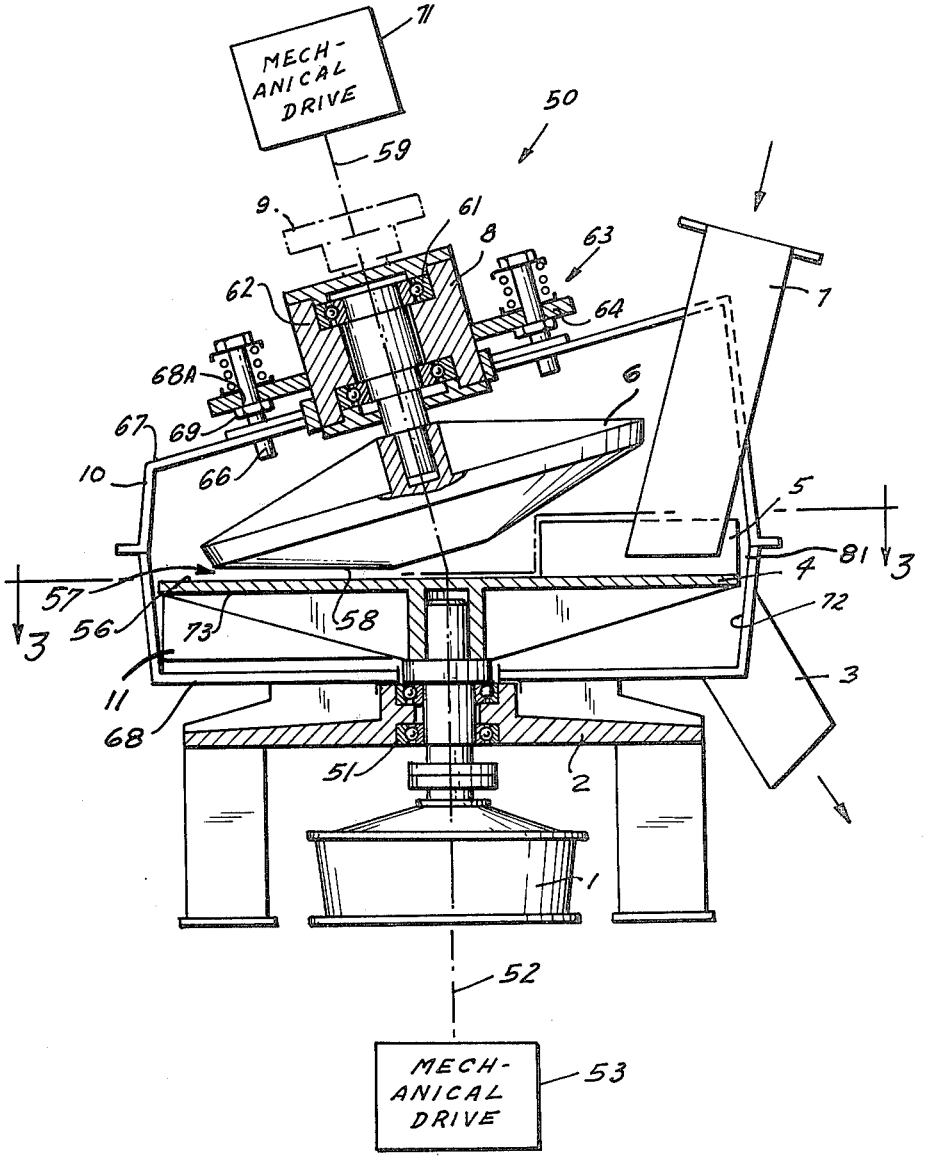
FIG. 1 is a view in vertical section of a disc-type material crusher constructed in accordance with the invention.

Referring to the drawing, a disc-type crusher 50 constructed in accordance with the invention includes a first bearing assembly 51 supported in a base frame 2, over which is disposed a housing in the form of a cover member 10. A first crushing disc 4 is horizontally disposed within the cover member 10, and is supported for rotation about a vertical axis 52 within the bearing member 51. The disc 4 is rotated about the axis 52 by means of a gear assembly 1, which is coupled to a conventional mechanical drive 53.

Material to be crushed is directed from a suitable chute (not shown) to an inlet conduit 7 which is supported in the cover 10. The bottom of the conduit 7 terminates opposite a material-receiving upper surface 56 of the disc 4, to be rotated by the drive 53 into a crushing zone 57.

The crushing zone 57 is defined between the upper surface 56 of the disc 4 and a cooperating surface 58 of a second cooperating disc member 6. The member 6 is generally conical in shape, and is tilted relative to the plane of the disc 4 for rotation about an axis 59 which is oblique to the vertical axis 52 of the disc 4. The disc 6 is carried in a second bearing member 61, which in turn is carried by a sub-housing 62 which is supported for linear movement along the axis 59.

The movement of the sub-housing 62, and thus the position of the surface 58 of the disc 6 relative to the surface 56 of the disc 4 to establish the height of the crushing zone 57, may be pre-set at any desirable value with the use of a spring-loaded locking arrangement 63 which cooperates with a radial flange 64 on the sub-housing 62. In particular, the locking arrangement 63 may include a pair of shafts 66, 66 which are symmetrically disposed on opposite sides of the axis 59 and which are carried in a top surface 67 of the housing 10. As indicated, the surface 67 is inclined relative to a bottom horizontal surface 68 of the cover 10, whereby the right-hand portion of the cover 10 as viewed in the drawing may have a larger volume than the left-hand portion.

The shaft 66 of the locking member 63 may extend through aligned apertures 68A, 68A in the sub-housing flanges 64, and may be threaded on their lower ends to receive nuts 69, 69 to fix the position of the flange 64 at a position corresponding to the desired height of the crushing zone 57.

The bearing element 61, and the disc 6 carried thereby, are rotatable about the axis 59 by means of an independent mechanical drive 71, through a suitable coupling 9.

A first rake or comb element 5 is secured to the cover member 10 as by projections 81 (only one of which is shown in FIG. 1) is associated with the upper, material-receiving surface 56 of the disc 4 for diverting material crushed in the zone 57 from the surface 56 to the bottom of a trough 72 which is situated in the lower portion of the cover member 10. As indicated, the comb element 5, which may illustratively be in the form of a flat surface having a lower edge in wiping engagement with the disc 4 as shown, is situated behind (clockwise beyond) the inlet chute 7 as shown in phantom lines in FIG. 3. A second comb element 11 affixed to a bottom surface 73 of the disc 4 cooperates with a discharge chute 3 for moving the crushed material out of the trough 72 for suitable utilization.

Figure 2:
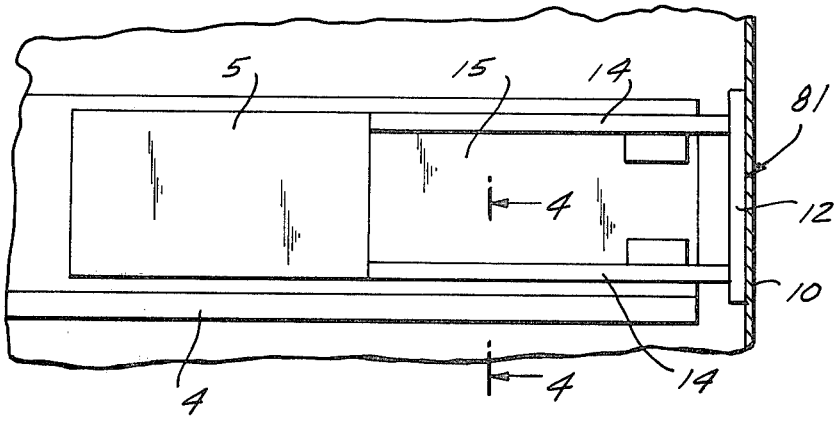
FIG. 2 is a fragmentary view on an enlarged scale of a portion of the crusher shown in FIG. 1.
Figure 3:
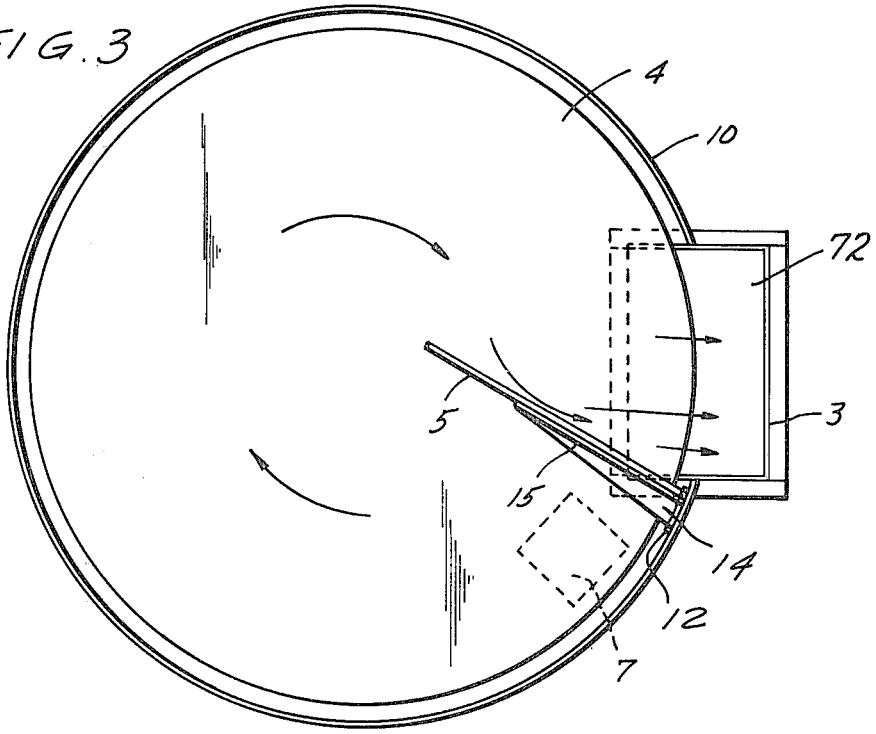
FIG. 3 is a view in horizontal section through the crusher, the section being taken along the broken line 3—3 in FIG. 1.
Figure 4:
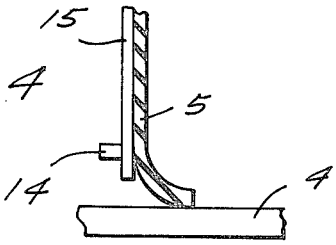
FIG. 4 is a fragmentary view in section taken along line 4—4 in FIG. 2.

As shown in FIG. 3, the first rake or comb element 5 is mounted at an angle with respect to the diameter of a disc 4, the mounting of the rake 5 is somewhat schematically shown at 81 in FIG. 1. In FIG. 2 an actual mounting 81 is shown. A reinforcing plate 12 is secured to the inner surface of the body 10. Extending inwardly from the plate 10 are two vertically spaced parallel arms 14. Secured to the forward face of the arms 14 is a composite member comprising a reinforcing metal plate 15 to the forward base of which there is secured an elastomeric sheet member 5, as shown in FIG. 4.

In an unillustrated alternative embodiment, the comb 5 may be adjustably mounted on the housing or body 10 in order to increase or decrease as desired the angle between the broad extent of the rake 5 and the diameter of the disc 4 extending through the center of the chute 3.

In the operation of the apparatus shown, material to be crushed is fed through inlet conduit 7 and is deposited upon the surface 56 of the disc 4. As the disc 4 rotates clockwise (FIG. 3), it carries the material deposited thereon to the crushing zone or slot 57 between the lower disc 4 and the upper disc 6. After the material has been crushed at zone 57, it is carried clockwise by disc 4 to the rake or comb 5. Then by means of the comb 5, material is directed or swept radially outwardly of the rotating disc 4 and the body 10 and thence into the discharge passage 72 in chute 3. Disc 4 is driven at a relatively low speed, so that there is no danger of the throwing out of the material due to centrifugal forces. It will be understood that the second rake 11, which is secured to the underside of disc 4, constantly rotates with the disc and serves to sweep away the material that has by chance entered through the slot between the disc 4 and the body or housing 10. Rake 11 is mounted at an angle with respect to a diameter of disc 4 which is similar to the angle at which the first rake 5 is mounted with respect thereto. Thus the second rake 11 progressively pushes material lying upon the upper face of the lower portion 68 of the body 10 radially outwardly to be discharged through the discharge chute 3.

In the foregoing, an illustrative arrangement of the invention has been described. Many variations and modifications will now occur to those skilled in the art. It is accordingly desired that the scope of the appended claims not be limited to the specific disclosure herein contained.

What is claimed is:

1. In an apparatus for crushing hard materials, a housing, a first substantially planar crushing disc supported for rotation in the housing about a first vertical axis, a second substantially conical crushing disc supported in the housing above the first disc for rotation about a second axis oblique to the first axis, the second disc cooperating with the underlying first disc to define a crushing zone therebetween, means for rotating the first disc about the first axis, inlet means supported in a first portion of the housing spaced from the crushing zone for introducing hard material to be crushed onto the first disc to be conveyed downstream through the crushing zone as the first disc rotates, first rake means secured to the housing and disposed in the path of rotation of the first disc downstream of the crushing zone and upstream of the inlet means for diverting material crushed in the crushing zone from the first disc toward the bottom of the housing, and outlet means supported by the housing for discharging crushed material directed toward the bottom of the housing by the first rake means.

2. Apparatus as defined in claim 1, further comprising means for rotating the second disc about the second axis.

3. Apparatus as defined in claim 1, further comprising means for adjusting the position of the second disc along the second axis relative to the first disc.

4. Apparatus as defined in claim 3, in which the apparatus further comprises bearing means supported by an upper wall of the housing for movement along the second axis, and in which the adjusting means comprises lockable means for moving the bearing means into an adjustable position along the second axis.

5. Apparatus as defined in claim 1, in which the first and second axes intersect within the housing.

6. Apparatus as defined in claim 1, in which the first rake means comprises a first element supported above the material-bearing surface of the first disc.

7. Apparatus as defined in claim 6, further comprising second rake means affixed to the bottom surface of the first disc for directing crushed material in the bottom of the housing to the outlet means.

* * * * *